US006668941B2

(12) United States Patent
Phillips et al.

(10) Patent No.: US 6,668,941 B2
(45) Date of Patent: Dec. 30, 2003

(54) SCREW HOLDING AND DRIVING DEVICE

(75) Inventors: Gregory A. Phillips, La Grange, KY (US); Carl W. Risen, Jr., Louisville, KY (US); Kevin M. Ward, Louisville, KY (US); Steven H. Taylor, Crestwood, KY (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 09/995,946

(22) Filed: Nov. 28, 2001

(65) Prior Publication Data

US 2003/0098169 A1 May 29, 2003

(51) Int. Cl.[7] ..... B25D 15/00

(52) U.S. Cl. ..... 173/93.5; 81/438; 173/29; 173/4

(58) Field of Search ..... 173/4, 11, 13, 173/29, 93.5; 227/119, 136, 137; 81/438, 439, 451

(56) References Cited

U.S. PATENT DOCUMENTS 2,829,685 A * 4/1958 Mitchell ..... 81/451
2,840,126 A * 6/1958 Schmitt ..... 81/57.42
3,056,441 A * 10/1962 Helms ..... 81/429
4,237,946 A * 12/1980 Leitner ..... 81/429
4,647,260 A * 3/1987 O'Hara et al. ..... 408/241 S
4,736,658 A 4/1988 Jore
4,925,082 A * 5/1990 Kim ..... 227/120
5,309,799 A 5/1994 Jore
5,499,562 A * 3/1996 Feng ..... 81/177.4
5,682,800 A 11/1997 Jore
5,992,274 A * 11/1999 Lammers ..... 81/451

* cited by examiner

*Primary Examiner*—Scott A. Smith
*Assistant Examiner*—Nathaniel Chukwurah
(74) *Attorney, Agent, or Firm*—Maginot, Moore & Beck

(57) ABSTRACT

A screw holding and driving device (42) for a power drill (40) is characterized by a body (46), a guide tube (48) reciprocatingly retained by the body, a drive assembly (90) held by the body (46) and operatively coupled to the guide tube (48), and, in certain embodiments, a screw depth adjuster (102). The guide tube (48) is configured to allow individual, top loading of screws for driving. The depth adjuster (102) is rotatable on the body to variably set screw driving depth. The body (46) can also include an integrally formed, bit storage caddie (54).

22 Claims, 11 Drawing Sheets

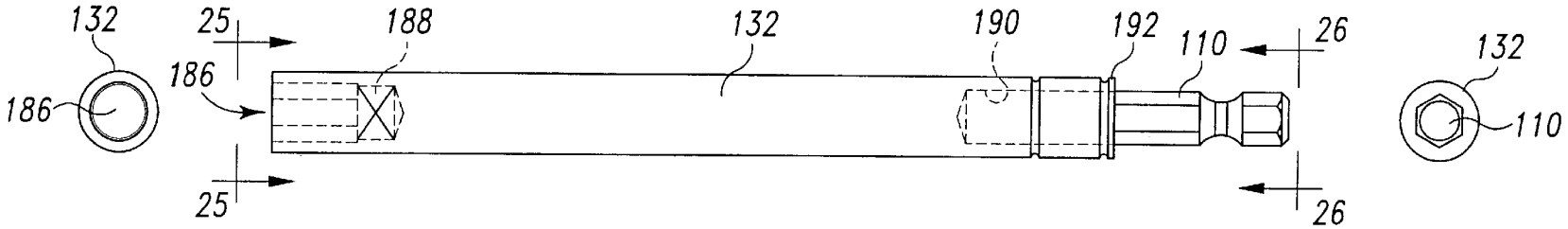
Fig. 26
Fig. 24
Fig. 25
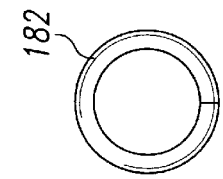
Fig. 28
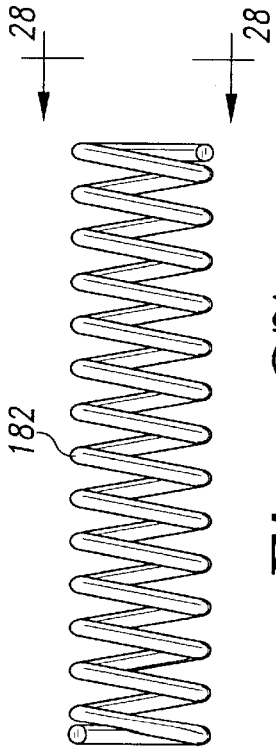
Fig. 27

SCREW HOLDING AND DRIVING DEVICE

BACKGROUND OF THE INVENTION

The present invention relates generally to screw holding and driving tools and, more particularly, to a screw holding and driving tool for use with a powered drill.

Various screw holding and driving devices have been proposed for aiding in the insertion and retention of a tip of a tool such as a screwdriver or power drill in position and contact with a screw for and while the screw is being driven into a work piece. One type of device for a screwdriver is a hollow, generally cylindrically shaped centering sleeve that extends beyond the tip and blade of the screwdriver to surround part or all of the screw head. The centering sleeve must normally be made at least partially retractable so as not to interfere with proper screw engagement if the screw head is to be driven flush with the surface.

Another such holding and driving device is disclosed in U.S. Pat. No. 4,736,658 issued to Jore on Apr. 12, 1988. The Jore screw holding and driving device has a shank secured at one end to a handle and a screw driving bit at another end of the shank. A sleeve is positioned in surrounding relation to the shank and sized to slidably rotate around the shank and to slidably move in a longitudinal direction with respect to the shank. The sleeve is used to hold a screw head during the driving operation. Retaining means are provided to hold the sleeve on the shank.

The above devices keep the tip of the screwdriver onto the screw head, but are not applicable to power drills. With respect to power drills, it has been recognized that a drill operator cannot see the position of the screw nor easily determine the angle, speed, or depth that a screw is driven into a work piece. Therefore, various devices have been proposed for power drills. These devices, however, make it typically difficult to load a screw into the device. As well, it is generally difficult to see easily set to a driving depth for the screw into the work piece.

What is needed therefore is a screw holding and screwing device for a power drill, which overcomes one or more drawbacks of the previously designed devices.

For example, what is needed is a screw holding and screwing device for a power drill that allows the easy loading of screws therein.

Moreover, for example, what is needed is a screw holding and screwing device for a power drill that provides an adjustable depth setting for driving the screw into a work piece.

Further, for example, what is needed is a screw holding and screwing device for a power drill that provides on tool storage for screw bits.

SUMMARY OF THE INVENTION

The present invention is a screw holding and driving device for a power drill. The screw holding and driving device includes a body, a guide tube, and a drive assembly. The body, guide tube, and drive assembly cooperate to receive and retain a screw for driving the screw into a work piece.

In one form, the screw holding and driving device also includes a depth adjuster for setting a driving depth of the screw.

In another form, the screw holding and driving device provides for top loading of a screw directly into the drive tube.

In yet another form, the screw holding and driving device includes an on-tool storage caddie for screw bits.

The present screw holding and driving device guides a screw into a work piece and helps prevent cam out. Screws are easily loaded and visible to the operator once loaded so that the operator can see depth, angle, and speed that the screw is being driven. The spring-loaded nature of the guide tube provides automatic extension of the guide tube to the loading position. The free spinning body with the integral bit holder helps prevent drywall tearing. Off center mass allows for the screw loading slot to always present itself upwards. The present device also extends the reach of the power tool by reaching areas of limited access and provides a convenient storage for additional bits.

As well, the present invention has a magnetic bit to hold the screw in a correct starting position and helps prevent the screw from falling out of the guide tube before the screw is driven. The body and guide tube cooperate to provide a releasable lock position when the guide tube is in a retracted position. The depth adjustment allows for countersinking or raised screw heads.

In an alternative embodiment, a simplified construction is utilized in which the spring-loaded guide tube provides an annular bore to receive a portion of the spring within the guide tube. In this embodiment, the apparatus is end-loaded, rather than side-loaded. The function of this embodiment is otherwise the same as for the other embodiments.

It is therefore an object of the present invention to provide a new and useful screw holding and driving tool.

It is another object of the present invention to provide an improved screw holding and driving tool.

Other objects and benefits of the present invention can be discerned from the following description and accompanying drawings.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings wherein:

FIG. 24 is a side view of a shaft for the present screw holding and driving tool;

FIG. 25 is an end view of the shaft of FIG. 24 taken along line 25—25 thereof;

FIG. 26 is and end view of the shaft of FIG. 24 taken along line 26—26 thereof;

FIG. 27 is a side view of a spring for the present screw holding and driving tool;

FIG. 28 is an end view of the spring of FIG. 27 taken along line 28—28 thereof;

Corresponding reference characters indicate corresponding parts throughout the several views. The exemplification set forth herein illustrates a preferred embodiment of the invention, in one form, and such exemplification is not to be construed as limiting the scope of the invention in any manner.

DESCRIPTION OF THE PREFERRED EMBODIMENTS

Figure 1:
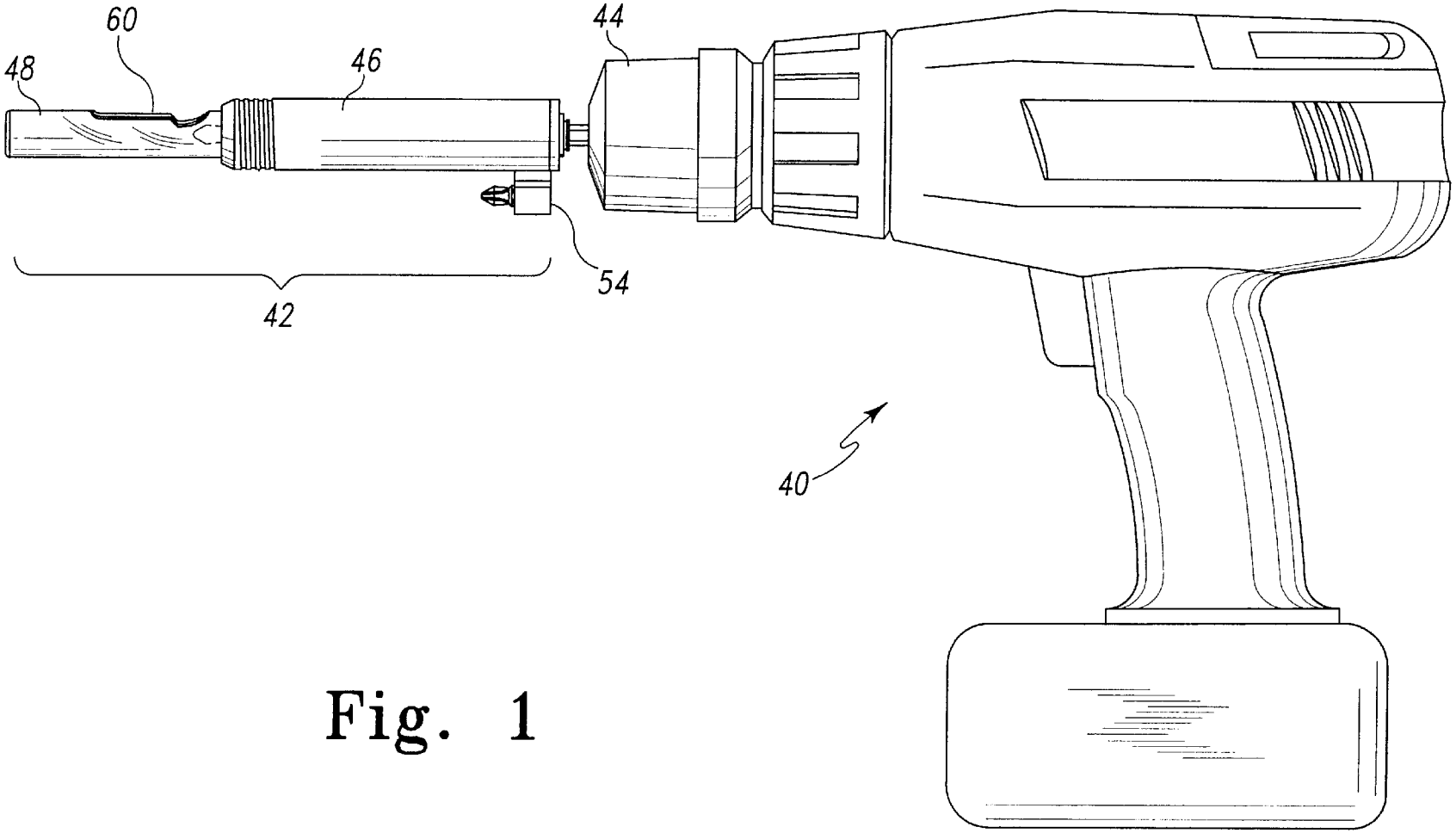
FIG. 1 is a front perspective view of an embodiment of a screw holding and driving tool in accordance with the present principles that is operatively attached to an exemplary powered drill.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a portable power drill 40 having a screw receiving, holding and/or driving device 42 (hereinafter screw device) created in accordance with principles presented herein attached to the power drill 40 in a conventional manner. The screw device 42 is configured to be removably received in a chuck portion 44 of the power drill 40 and operably attached thereto. The screw device 42 includes a body 46, a spring loaded screw receiving, guide and/or holding tube or sleeve 48 (hereinafter guide tube), and a drive assembly (see FIG. 2).

The guide tube 48 is preferably normally in an extended position relative to the body 46 as is depicted in FIG. 1. The extended position of the guide tube 48 allows receipt of a screw (not shown) within the guide tube 48 that is to be screwed into a work piece (not shown) [hereinafter synonymously the screwing operation]. The screw is received through a configured opening in the side wall of the guide tube 48. The screw is thereafter retained in the guide tube 48 adjacent a screw bit for the screwing operation. The guide tube 48 is adapted to axially retract towards the body 46 and substantially coaxial therewith during the screwing operation. The guide tube 48 is normally biased into the extended position and thus has a tendency to return to the extended position after release of axial pressure therefrom (i.e. the end of the screwing operation).

Figure 2:
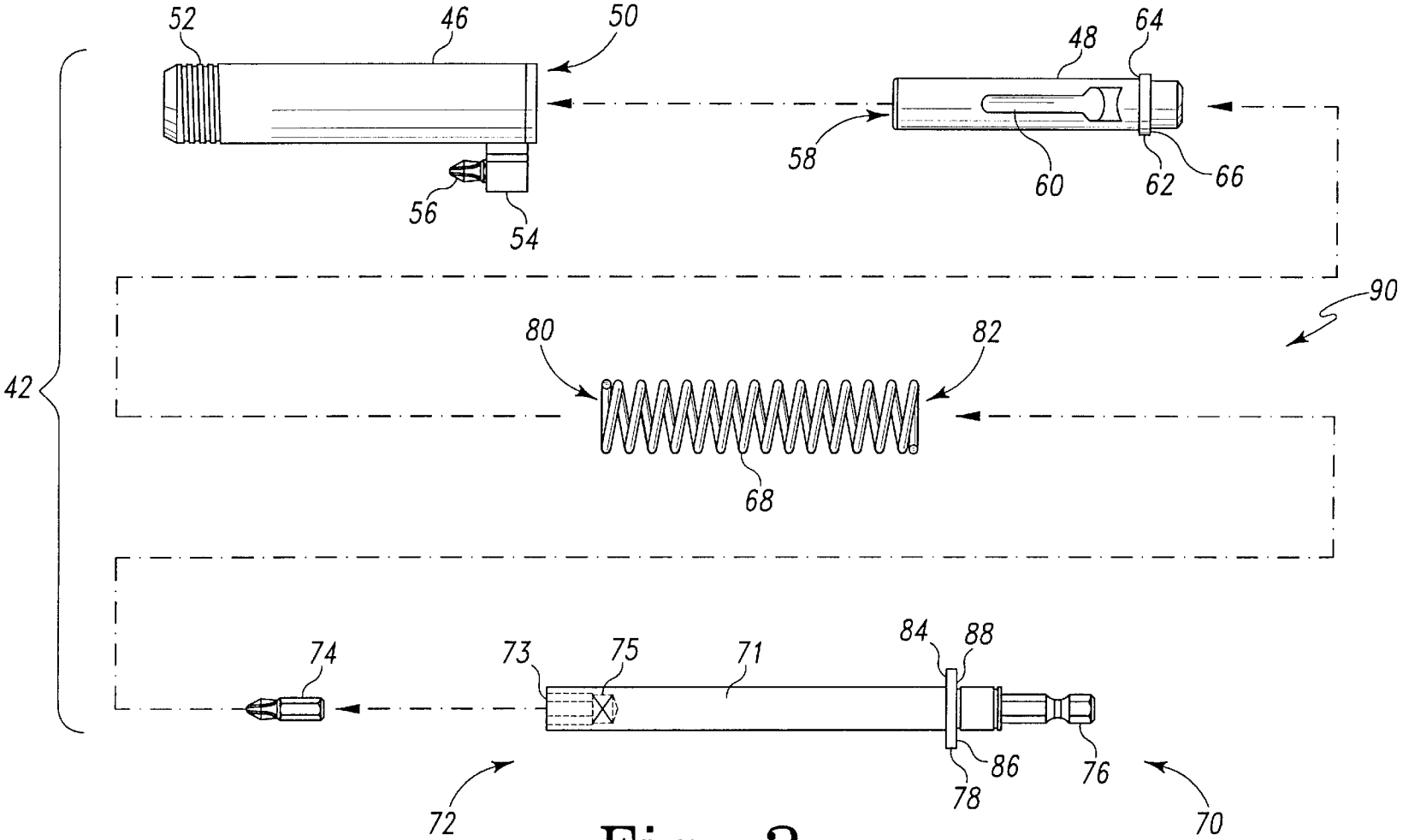
FIG. 2 is an exploded view of the screw holding and driving tool of FIG. 1.

Referring to FIG. 2, components of the screw device 42 are shown in an exploded view. Essentially, the screw device 42 is composed of the body 46, the guide tube 48, and the drive assembly 90. The drive assembly 90 is adapted to receive a screw bit 74 and is essentially composed of a drive shaft assembly 70 and a spring 68. The body 46 slidably retains the guide tube 48 within a bore or hole 50 of the body 46 that extends the length of the body 46. The bore 48 is essentially annular to accommodate the essentially annular guide tube 48. The body 46 is thus essentially cylindrical and includes a draft or taper 52 at one end thereof. Among other reasons, the draft 52 aids in the molding process, especially when pertaining to plastics.

The body 46 further includes a bit stow, rack or storage device 54 radially depending from an end thereof and preferably formed integral therewith. A screw bit 56 is shown retained by the bit stow 54 in FIG. 2. The bit stow 54 may hold any number of insert (e.g. screw, drill) bits. In the present embodiment, the bit stow 54 holds three (3) insert bits using a friction retention configuration.

The guide tube 48 essentially defines a cylinder and thus has a central bore or hole 58 extending the axial length thereof. The guide tube 48 is preferably formed of a relatively clear material. A drive shaft assembly 70 cooperates with the guide tube 48 and the body 46 to form the screw device 42. The guide tube 48 includes a screw opening 60 in a side wall thereof that is configured to receive a head and shank portion of a screw (not shown). The screw opening is configured to define a profile of a screw to accommodate the screw head and shank portions thereof. The guide tube 48 further includes a collar 62 on one end thereof. The collar 62 is a radially outwardly extending annular flange or ridge that defines first and second stop and/or seating surfaces. In particular, the collar 62 defines two essentially annular, axial seating surfaces; namely, a front seating surface 64 and a rear seating surface 66. The front seating surface 64 is adapted to contact a stop surface within the bore 50 (e.g. depending from a sidewall) of the body 46 to axially limit the extended position of the guide tube 48 relative to the body 46 when the guide tube 48 is biased into the extended position. The rear seating surface 66 is adapted to contact or abut an end 80 of a spring 68 of the drive shaft assembly 90. An anti-rotator feature is configured between the guide tube 48 and the body 46 as explained below, in order to maintain the guide tube 48 rotationally fixed relative to the body 46.

The drive shaft assembly 70 includes a drive shaft 71, a bearing cap 78, and a bit retainer 72. The bearing cap 78 is disposed on the drive shaft 71 proximate an end that is formed into a shank 76. The bearing cap 78 includes a radially outwardly extending annular flange or ridge that defines first and second stop and/or seating surfaces. Particularly, the bearing cap 78 defines first and second annular, axial stop surfaces; namely a front stop surface 84 and a rear stop surface 86. The front stop surface 84 is adapted to abut an end 82 of the spring 68, while the drive shaft 71 is within the spring 68. The bearing cap 78 of the drive shaft 70 is rotatably retained on the drive shaft 71 with the aid of at least a snap ring 88 and associated annular groove (not shown) in the surface of the drive shaft 71.

The drive shaft 70 extends through the opening 58 of the guide tube 48 and the opening 50 of the body 46. The bearing cap 78 is received inside the opening 50 of the body 46 and is retained within the body 46 by fasteners (not shown) such as screws that extend from the exterior of the body 46. In this manner, the drive shaft 70 is free to rotate within the guide tube 48 and body 46 since the bearing cap 78 of the drive shaft 70 is fixed relative to the body 46. The guide tube 48 is also preferably rotatably fixed within the body 46. The drive shaft 70 includes the bit retainer 72 in an end thereof opposite the shank 76. The bit retainer 72 includes an internal magnet 75 at an end of an opening 73. The opening 73 is configured to receive an end of a complementarily configured screw bit 74, typically of a hexagonal configuration. The screw bit 74 is susceptible to magnetism such that the magnet 75 within the drive shaft 71 at the end of the opening 73 magnetically retains the screw bit 74. The shank 76 is configured/adapted to be received in the chuck portion 44 of the power drill 40. The power drill 40 thus rotates the drive shaft 71 for the screwing operation.

The spring 68 normally axially biases the guide tube 48 into the extended position from the body 46 as depicted in FIG. 1. A screw is inserted into the guide tube 48 from the screw opening 60 with the head of the screw towards the power drill 40 and the tip away from the power drill 40. The screw head is magnetically held onto the screw bit 74, such that the screw is axially retained within the guide tube 48. The end of the guide tube 48 is positioned over a suitable place for the screw, after which the power drill 40 is caused to rotate the drive shaft 70 and thus the screw via the screw bit 74. The screw bit 74 is chosen to be received on the particular type of screw being used. Axial pressure against the power drill 40 during the screwing operation pushes the guide tube 48 against a work piece. This axial pressure compresses the spring 68 between the rear seating surface 66 of the stop collar 62 of the guide tube 48 and the front stop surface 84 of the stop collar 78 of the drive shaft 71 within the body 46 which allows the axial movement of the guide tube 48 towards the power drill 40. Axial movement of the guide tube 48 towards the power drill 40 ceases when the end of the body 46 abuts the work surface. The screwing operation is then complete.

Figure 3:
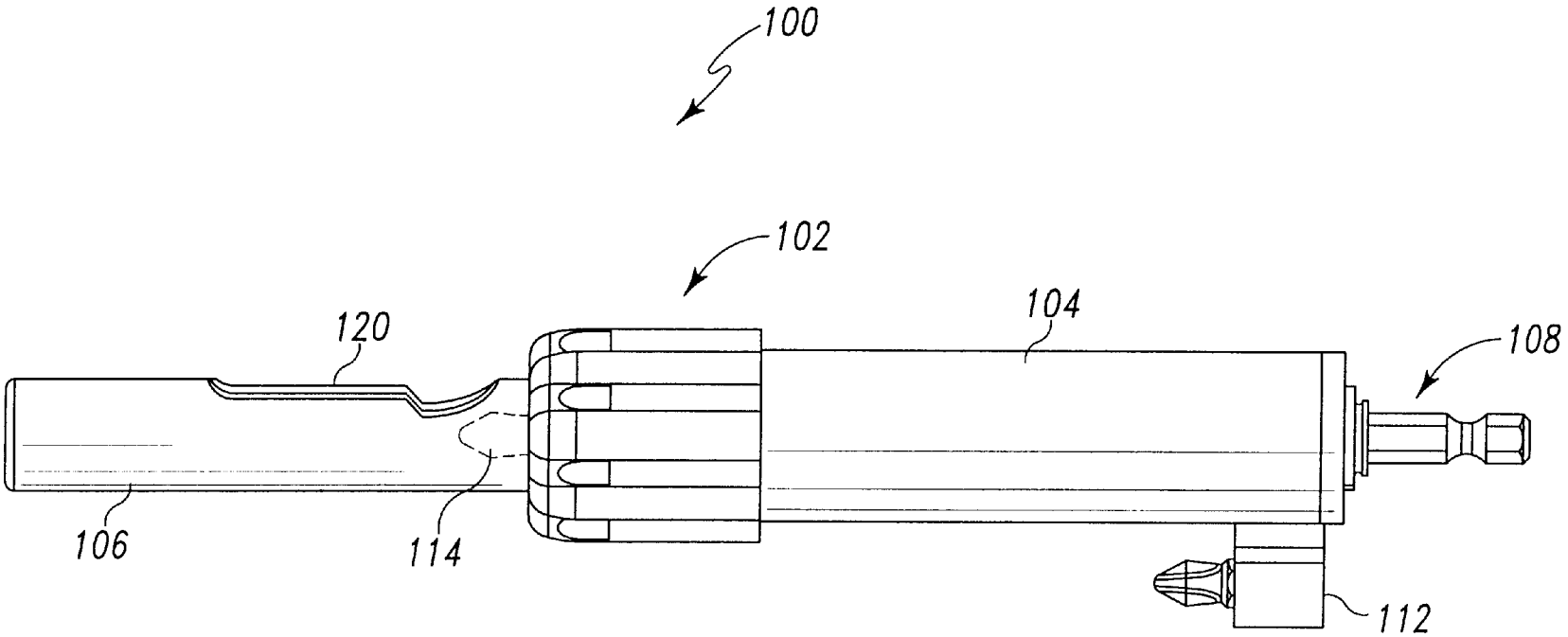
FIG. 3 is a front perspective view of another embodiment of a screw holding and driving tool in accordance with the present principles.

Referring now to FIG. 3, there is shown another embodiment of a screw device generally designated 100. The screw device 100 is substantially the same as the screw device 42 in form, function, and operation with the exception of a depth adjuster 102. The depth adjuster 102 of the screw device 100 allows adjustment of the driving depth of the screw. It should be appreciated that the various features explained below with reference to the screw device 100, apart from the depth adjuster 102, apply to the screw device 42 and vice versa unless otherwise indicated.

The screw device 100 includes a body 104, a spring loaded screw receiving, guide and/or holding tube or sleeve 106 (hereinafter guide tube), a drive assembly 108, and a depth adjuster 102. An insert bit stow 112 depends from the body 104 and is preferably formed integral therewith. A bit 114 is shown in the screw device 104.

Figure 4:
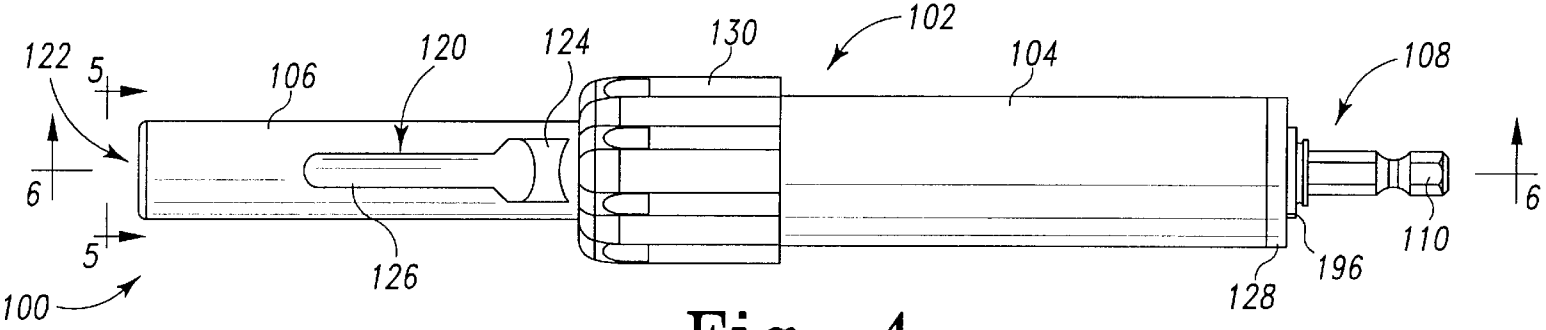
FIG. 4 is a top plan view of the screw holding and driving tool of FIG. 3.

Referring now to FIG. 4, there is shown a top plan view of the screw device 100. The guide tube 106 is shown in the extended position relative to the body 104. A shank 110 of the drive assembly 108 extends from a bearing cap 128 that is attached to an end of the body 104. The shank 110 is adapted to be received in a chuck of a drill. Preferably, the shank 110 is configured to be received in all ½" and ⅜" drills. An adjustment sleeve 130 of the depth adjuster 102 is disposed at an end of the body 104 with the guide tube 106 extending from the body 104/adjustment sleeve 130.

With additional reference to FIGS. 7–10, the guide tube 106 will be described in greater detail. The guide tube 106 is preferably made of a plastic such as a polycarbonate. As well, the guide tube 106 is preferably transparent in order to discern a screw that has been placed therein, and particularly, a color tinted transparent grade of polycarbonate. It should be appreciated, however, that other suitable materials of various light properties may be used. The guide tube 106 includes a screw opening 120 disposed in the cylindrical sidewall defining the guide tube 106. The screw opening 120 is in communication with a cylindrical bore or opening 122 in the guide tube 106. The screw opening 120 is configured to receive a screw by having a shank opening portion 126 and a head opening portion 124. The shank opening portion 126 allows a shank of a screw to pass therethrough, while the head opening portion 124 allows a head of the screw to pass therethrough. In other words, the screw opening 120 follows the profile of the screw or fastener to restrict the orientation of the fastener for insertion.

Figure 6:
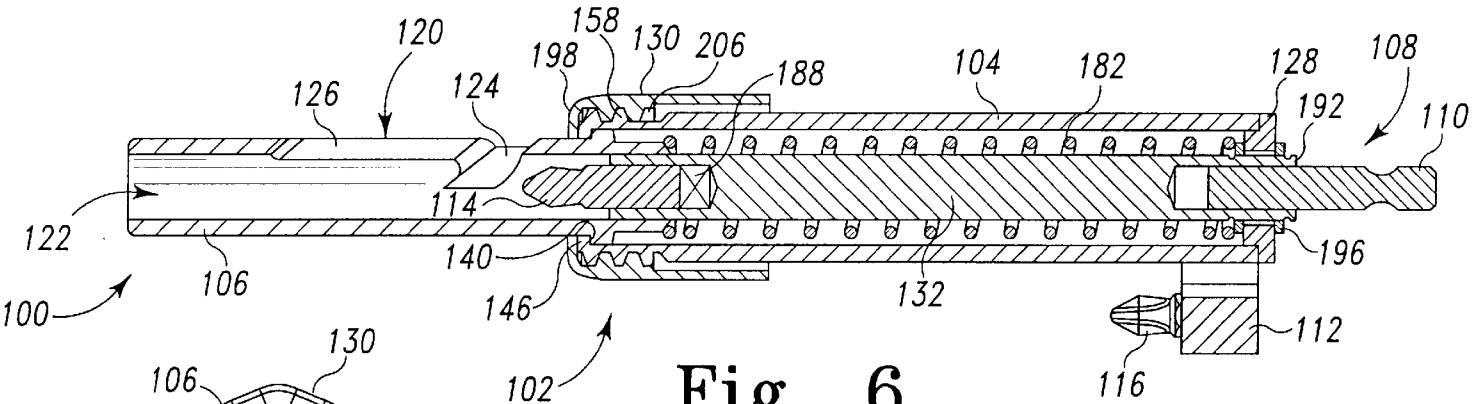
FIG. 6 is a cross-sectional side view of the screw holding and driving tool of FIG. 4 taken along line 6—6 thereof.

Each end of the guide tube 106 includes a respective draft or taper 134, 136. The guide tube 106 further includes an annular collar 138 proximate one end thereof. The annular collar 138 extends radially outwardly from the guide tube 106 and defines first and second axial seating surfaces. Particularly, the collar 138 defines a forward seating surface 140 and a rearward seating surface 142. As best seen in FIG. 6, the forward seating surface 140 abuts a radially inward stop surface 146 of the body 104 to prevent the guide tube 106 from exiting the body 104 and to limit the forward travel of the guide tube 106 relative to the body 104 when the guide tube 106 is in the extended position.

Figure 12:
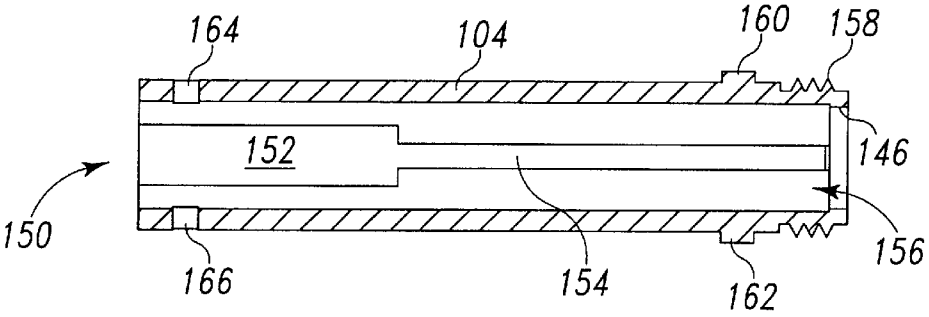
FIG. 12 is a cross-sectional view of the body of FIG. 11 taken along line 12—12 thereof.
Figure 11:
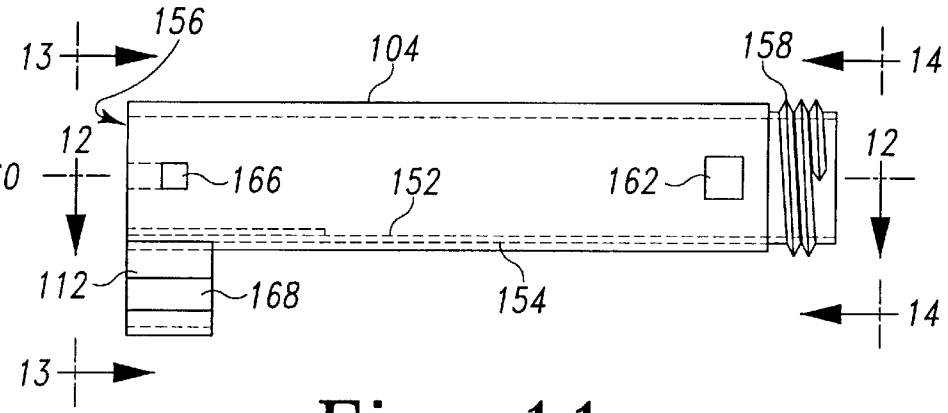
FIG. 11 is a side view of a body for the present screw holding and driving tool of FIG. 3.
Figure 14:
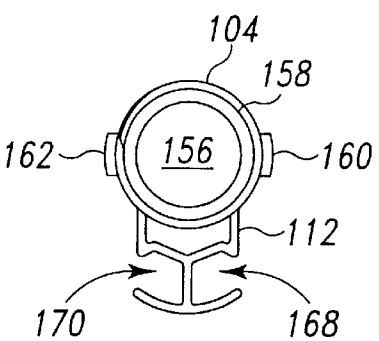
FIG. 14 is an end view of the body of FIG. 11 taken along line 14—14 thereof.
Figure 13:
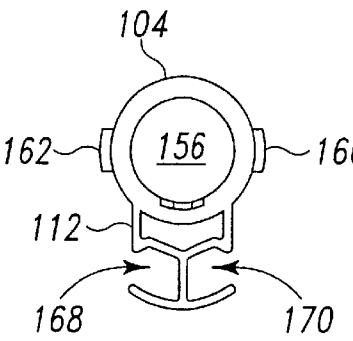
FIG. 13 is an end view of the body of FIG. 11 taken along line 13—13 thereof.
Figure 15:
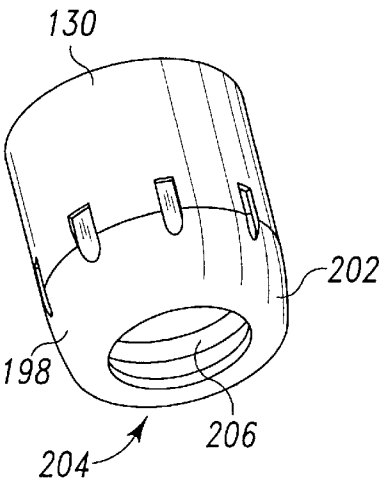
FIG. 15 is a perspective view of a sleeve for the present screw holding and driving tool of FIG. 3.
Figure 17:
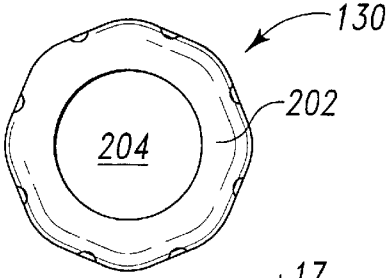
FIG. 17 is an end view of the sleeve of FIG. 16 taken along line 17—17 thereof.
Figure 16:
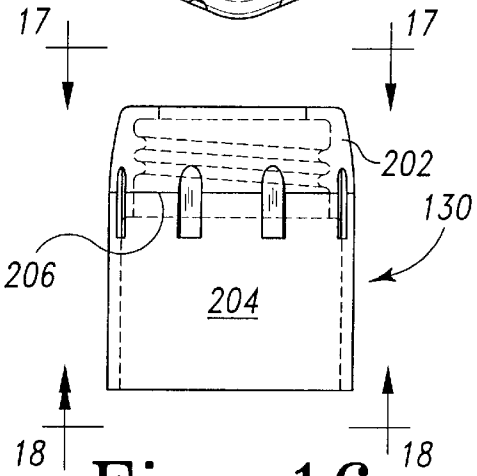
FIG. 16 is a side view of the sleeve of FIG. 15 showing internal threads and a cavity in phantom.
Figure 18:
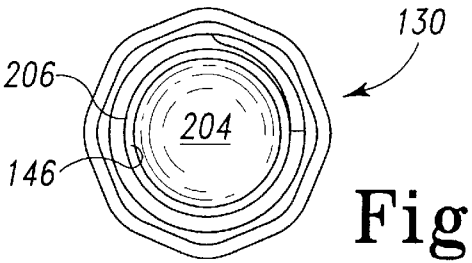
FIG. 18 is an end view of the sleeve of FIG. 16 taken along line 18—18 thereof.
Figure 19:
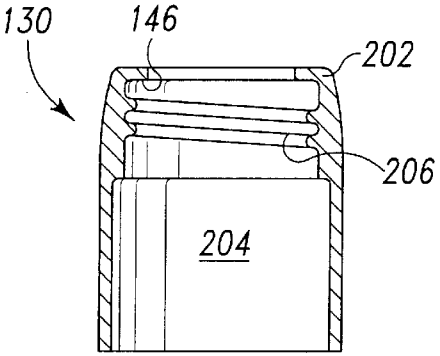
FIG. 19 is a side cross-sectional view of the sleeve of FIG. 15.

The guide tube 106 further includes an anti-rotation member 144 depending from the collar 138. The anti-rotation member 144 cooperates with a groove 150 (having groove sections 152 and 154) on an inside surface of the body 104 (see FIG. 12) to rotationally fix the guide tube 106 within the body 104.

Referring now to FIGS. 11–14, the body 104 will be described in greater detail. The body 104 is preferably made of a plastic such as an ABS (medium to high impact grade) plastic molded as one, integral piece. The body 104 is essentially cylindrical and thus defines an internal bore or hole 156 that extends the longitudinal length of the body 104. The groove 150 formed by a first groove portion 152 and a second groove portion 154 extend longitudinally along an inside surface of the body 104. The groove 150 cooperates with the anti-rotation member 144 such that the anti-rotation member 144 is retained in the groove portions 152 and 154 during extension and retraction of the guide tube 106 within the body 104.

The body 104 further has a radially inward annular flange 146 formed on an inside surface of the body 104 at one end thereof. Threads 138 are formed on an outside surface of the body 104 at the same end thereof as part of the depth adjuster 102 to cooperate with the adjustment sleeve 130. Two radially projecting stops 160 and 162 are formed on the outside surface of the body 104 proximate the threads 138 and act as detent position holders for the sleeve 130 when the sleeve 130 is rotated. This aids in maintaining the sleeve 130 in its rotated position and preventing inadvertent rotation.

Figure 5:
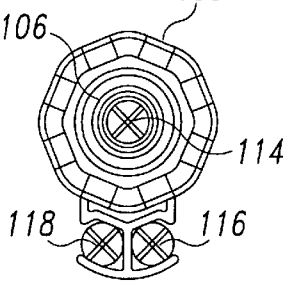
FIG. 5 is a front plan view of the screw holding and driving tool of FIG. 4 taken along line 5—5 thereof.
Figure 7:
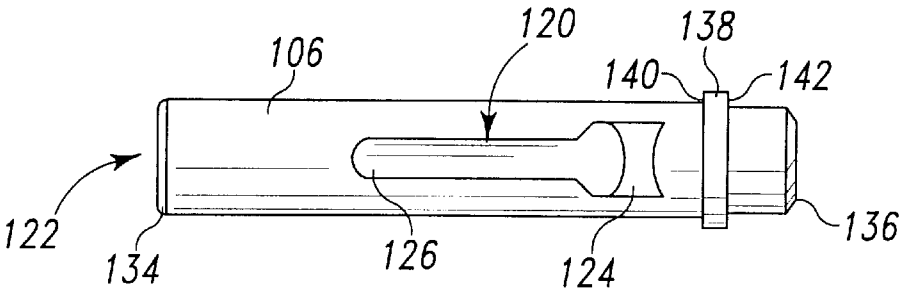
FIG. 7 is a top plan view of a guide tube for the present screw holding and driving tool.
Figure 8:
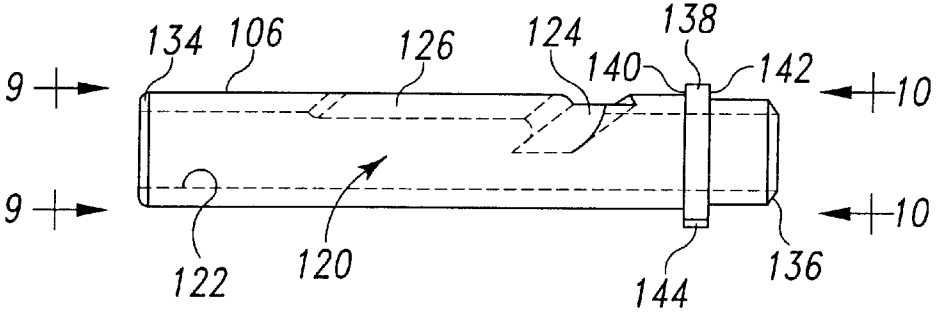
FIG. 8 is a side plan view of the guide tube of FIG. 7.
Figure 9:
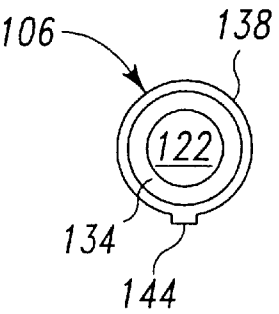
FIG. 9 is an end view of the guide tube of FIG. 8 taken along line 9—9 thereof.
Figure 10:
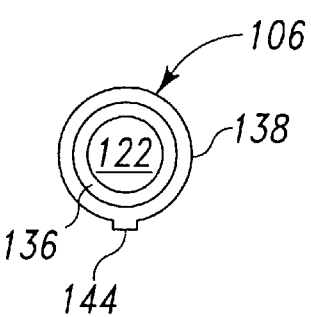
FIG. 10 is an end view of the guide tube of FIG. 8 taken along line 10—10 thereof.

The body 104 also includes the bit stow 112 that is preferably integrally formed with the body 104 and which is configured to hold insert bits. The particular bit stow 112 includes two bays 168 and 170 to each retain an insert bit such as the bits 116 and 118 seen in FIGS. 5 and 6. The body 104 also includes two notches 164 and 166 on one end thereof that are adapted to receive hooks or prongs of the bearing cap 128.

Figure 20:
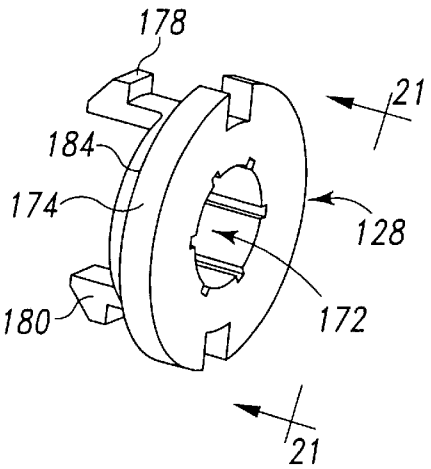
FIG. 20 is a perspective view of a bearing cap for the present screw holding and driving tool.
Figure 21:
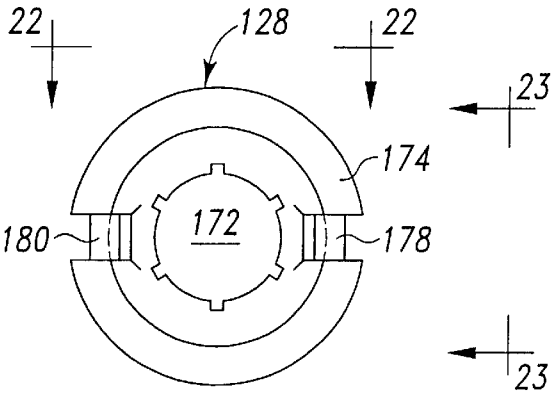
FIG. 21 is an end view of the bearing cap of FIG. 20 taken along line 21—21 thereof.
Figure 22:
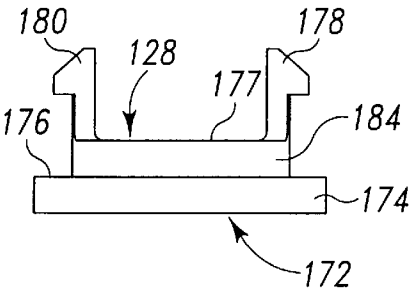
FIG. 22 is a side view of the bearing cap of FIG. 21 taken along line 22—22 thereof.
Figure 23:
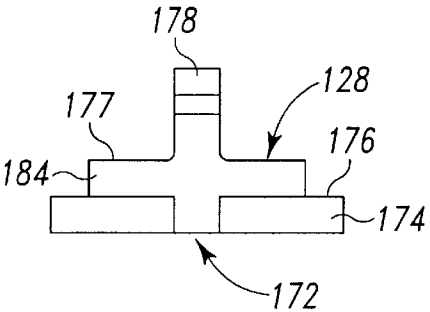
FIG. 23 is a side view of the bearing cap of FIG. 21 taken along line 23—23 thereof.

Referring to FIGS. 20–22 the bearing cap 128 is shown. The bearing cap 128 is preferably made of a plastic, such as an acetyl homopolymer (an unfilled general purpose grade). The bearing cap 128 includes a bore or aperture 172 that is configured to rotatably retain the drive shaft 132 of the drive assembly 108. The bearing cap 128 further includes a first annular or disc portion 174 that defines a first seating surface 178 for abutting against the end of the body 104, and an inner portion 184 defining a second seating portion 177 that abuts an end of the spring 182 (see FIG. 6). The bearing cap 128 also includes two hooked prongs 178 and 180 that are adapted to be received in the notches 164 and 166 of the body 104 to aid in retaining the bearing cap 128 onto the body 104. The bearing cap 128 is rotationally fixed relative to the body 104 to allow the drive shaft 132 and the shank 110 to rotate.

Referring to FIGS. 24–26 the drive shaft 132 of the drive assembly 108 is shown. The drive shaft 132 is preferably made of aluminum but other suitable materials may be used. The drive shaft 132 includes a bit retaining bore 186 in one end thereof that is configured to receive an end of a bit. The bore 186 is shown as hexagonal which is typical of bits. Of course, the bore 186 may be shaped differently. A magnet 188 is disposed at an axial end of the bore 186 for magnetically retaining a bit inserted into the bore 186.

The drive shaft 132 includes the shank 110 on the end opposite the bit bore 186. The shank 110 is preferably made of steel and is press fit into a shank bore 190. The shank 110 is configured to be received in a chuck of a drill for rotating the shank 110 which rotates the drive shaft 132 which rotates a bit in the bit bore 186. The drive shaft 132 further includes a first annular groove on an outside surface thereof proximate the shank 110 for receiving a snap ring or clip 196 (see FIGS. 4 and 6) to aid in retaining the bearing cap 128 onto the body 104. The drive shaft 132 further includes a second annular groove 194 on an outside surface thereof axially spaced from the first groove 192 that also aids in retaining the bearing cap 128 onto the body 104.

Referring to FIGS. 27 and 28, the spring 182 as part of the drive assembly 108 is shown. The spring 182 may be any type of spring suitable for the present application. Preferably, however, the spring 182 is made of plated music wire, 0.032" having a free length of 5.0" and an outside diameter of 0.470". As well, the spring 182 preferably has closed ends and sixteen (16) total coils.

Referring to FIGS. 15–19, the adjustment sleeve or sleeve 130 forming part of the adjuster 102 is shown. The sleeve 130 is preferably made of a plastic such as an ABS (medium to high impact grade) and is formed in a generally cylindrical shape thereby defining a central bore 204. The sleeve 130 includes a curved or tapered front or nose 202 having internal threads 206. The sleeve 130 is sized to be received over the body 104 with the threads 206 cooperating with the threads 158 of the body such that the sleeve 130 is rotatable on the body 104. The sleeve 130 also includes an annular stop surface 146 at the beginning of the threads 206 adjacent the taper 202.

The sleeve 130 is received on the body 104 as best seen in FIG. 6. In particular, the sleeve 130 extends over the body 104. The threads 206 of the sleeve 130 are engaged with the threads 158 of the body 104 such that the sleeve 130 is axially movable (i.e. by rotation), both axially forward and rearward, along and relative to the body 104. The seating surface 140 of the collar 138 of the guide tube 106 abuts the stop 146 of the body 104 when the guide tube 106 is in the extended position.

When axial rearward (i.e. towards the shank 110) pressure is exerted against the guide tube 106 during the screwing operation, the guide tube 106 axially compresses the spring 182 allowing the guide tube 106 to retract into the body 104. As the guide tube 106 retracts, the screw is driven into the work piece. Eventually, the guide tube 106 retracts at least flush with a front surface 198 (defined by the taper 202) of the sleeve 130. The front surface 198 of the sleeve 130 relative to the bit 114 is axially adjustable such that more or less (to none) of the bit 114 may be exposed from the front surface 198 when the guide tube 106 retracts and the front surface 198 reaches the work piece. Axially rotating the sleeve 130 in a clockwise direction axially moves the sleeve 130 and thus the front surface 198 axially rearward, exposing more of the bit 114. Since more of bit 114 is exposed, the head of the screw will be driven deeper into the work piece (relative to the surface of the work piece) before the device bottoms out (i.e. the front surface 198 contacts the work piece). Axially rotating the sleeve 130 in a counterclockwise direction axially moves the sleeve 130 and thus the front surface 198 axially forward, exposing less of the bit 114. Since less (to none or less) of the bit is exposed, the front surface reaches the surface of the work piece before the screw head, thereby having the screw head raised from the surface of the work piece. The axial rotation (adjustment) is infinitely variable within the range of rotation. Such range of rotation is restricted by the sleeve/body configuration (e.g. the threads 158 on the body 104). After the driving operation, axially forward pressure against the guide tube 106 is released, allowing the compressed spring 182 to uncompress and axially force the guide tube 106 into the normal, extended position.

It should be appreciated that the guide tube 48 includes a spring-loaded automatic return to the extended position that is also the screw loading position. This allows an operator to load screws and drive them using only one hand. The depth adjustment sleeve allows the operator to set the desired screw depth by simply turning the threaded sleeve. Adjustment depth is various depending on configuration, but a typical adjustment range is around 3/16".

Figure 29:
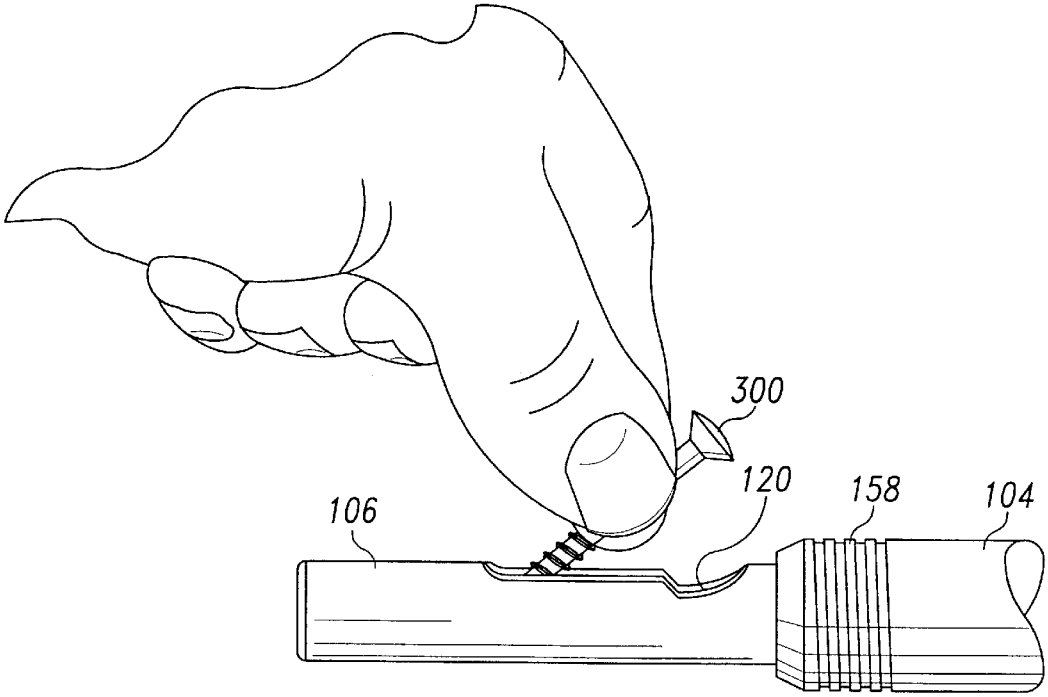
FIG. 29 is a diagram showing insertion of a screw into the present screw holding and driving tool.
Figure 30:
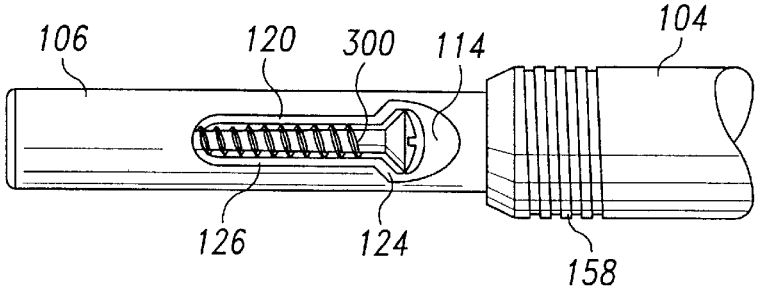
FIG. 30 is a diagram showing the screw being held by the screw holding and driving tool of FIG. 29.

The loading of a screw into the present screw device will now be described with additional reference to FIGS. 29 and 30. Initially, it should be appreciated that the body 104 in FIGS. 29 and 30 has had the sleeve 130 removed for clarity. A screw 300 is place into the screw opening 120 in the guide tube 106, with the shank of the screw into the shank opening portion 126 first, and thereafter the head of the screw into the head opening portion 124. The head of the screw is magnetically attracted to the bit 114, where it is retained thereon. The screw opening 120 is always presented facing up (top)

since the drive assembly is free spinning relative to the guide tube 106 and the body 104 and has an off center mass. The screw device is now ready for the screwing operation.

Figure 31:
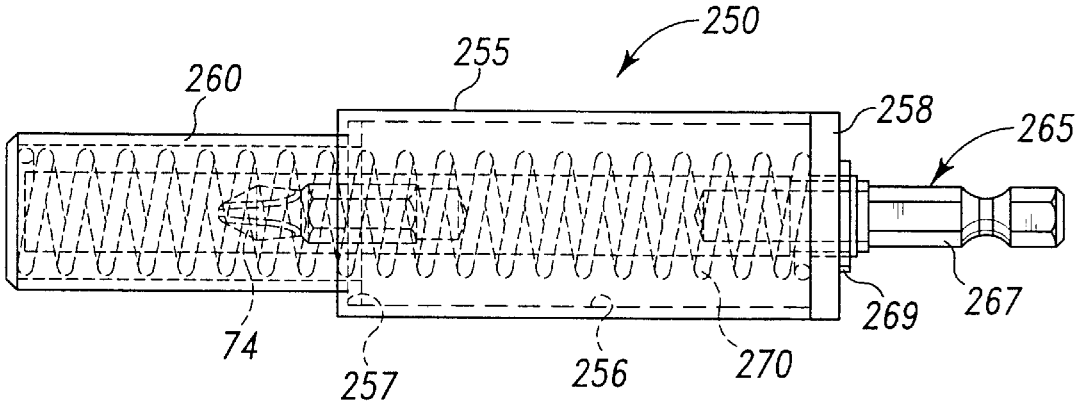
FIG. 31 is a side view of a screw holding and driving tool in accordance with a further embodiment of the invention.
Figure 32:
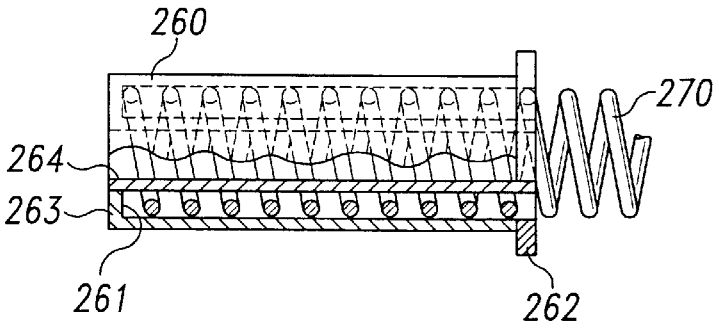
FIG. 32 is a side partial cut-away view of a guide tube for use with the tool depicted in FIG. 31.

An alternative embodiment of the invention is depicted in FIGS. 31 and 32. This embodiment implements end-loading of the screw, rather than the side loading capability found in the prior embodiments. In particular, a screw holding and driving device 250 includes a cylindrical body 255, and a guide tube 260 slidably disposed within a bore 256 of the body 255. A drive assembly 265 is disposed within the body 255 and guide tube 260, in a manner similar to the drive assembly 108 described above. As with the assembly 108, the drive assembly 265 of the present embodiment can include a drive shaft assembly 267 held in position relative to the body 255 while allowing the assembly to rotate. Preferably, a snap ring 269 is engaged about the shaft assembly 267 to hold the assembly in place.

In the embodiment depicted in FIGS. 31 and 32, the drive assembly 265 further includes a spring 270. Like the spring 68 in the prior embodiment, the spring 270 is arranged between the body 255 and the guide tube 260 to force the guide tube to a normally extended position, as shown in FIG. 31. Also, like the prior-discussed guide tubes, the guide tube 260 retracts within the body 255 as the device 250 is pressed against a work piece.

As shown in more detail in FIG. 32, the guide tube 260 is preferably in the form of an annular body. Thus, in this embodiment, the guide tube 260 includes an inner tube 264 attached to a radially inward annular end wall 263. The guide tube 260 thus defines an annular bore 261 between its outer wall and the inner tube. The inner tube 260 itself defines an inner guide bore through which the screw bit 74 and drive shaft assembly 267 project as the guide tube is retracted within the body 255.

To maintain the guide tube 260 within the bore 256 of the body 255, and to limit the range of travel of the guide tube within that bore, the guide tube further includes an annular collar 262. As shown in FIG. 31, the annular collar 262 is trapped within the bore 256 by an inward stop surface 257 at one end of the body 255, and by a bearing cap 258 at the opposite end of the body. The bearing cap 258 can be similar to the cap 128 described above in structure and function. In this particular embodiment, the bearing cap 258 is preferably permanently attached to the body 255 to close the bore 256 and retain the annular collar 262 and spring 270 within the body.

Referring back to FIG. 31, the guide tube 260 is shown with the spring 270 in its operative position. Specifically, the spring 270 resides within the annular bore 261 defined by the tube. Thus, in contrast to the embodiments described above, the drive device 250 of the present embodiment has the drive assembly spring 270 integrated within the guide tube, rather than bearing against a terminal end of the guide tube. This approach allows the drive device 250 to be more compact, while still allowing the guide tube 260 to function as described above.

It should be understood that with the spring 270 extending into the guide tube 260, side loading of a screw onto the screw bit 74 is problematic. With this embodiment, the screw to be driven is loaded into the open end of the guide tube. Preferably, the user can simply retract the guide tube to expose the screw bit 74 for placement of the screw thereon. This embodiment can make particularly good use of the magnet and magnetic bit feature described above to retain the screw on the bit as the guide tube 260 extends over the bit and screw. Of course, as the apparatus is used, the guide tube will bear against the work piece and will gradually retract within the body 255, against the force of the spring 270, as the screw is driven deeper into the work piece.

The body 255 and guide tube 260 of the screw holding and driving device 250 of the embodiment of FIGS. 31 and 32 is preferably formed of plastic. Most preferably, the guide tube 260 is formed of a transparent or translucent material to allow visualization of the driven screw within. In a specific embodiment, the individual elements of the guide tube 260 and body 255 can be attached with adhesive, or can be welded in a known manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For example, the present embodiments each utilize a coil spring concentrically disposed about the drive shaft. However, multiple springs are contemplated, whether concentric about the drive shaft or uniformly dispersed around the bore of the body of the device. Moreover, multiple concentric springs of different lengths can be utilized to provide varying spring force as the guide tube is pushed deeper into the body of the device.

Of course, while a coil spring is preferred for its simplicity, other resilient components or spring elements can be substituted that tend to bias the guide tube outward from the body of the device. Moreover, while a compression spring is preferred, an extension spring can be utilized with appropriate modification of the body and guide tube. For example, the extension spring can be attached at the front stop surface 146 of the body 104 and to the front stop surface 140 of the guide tube 106. As the guide tube is pushed into the body during a screwing operation, the extension spring is extended, and then retracts when the axial force is removed to pull the guide tube to its extended position.

Likewise, while the present embodiments show replaceable driving bits, the bit can be fixed to the drive shaft or formed as part of the shaft. Similarly, the drive shaft itself can be replaceable.

There are a plurality of advantages of the present invention arising from the various features of the screw holding and driving device described herein. It will be noted that alternative embodiments of the screw holding and driving device of the present invention may not include all of the features described yet still benefit from at least some of the advantages of such features. Those of ordinary skill in the art may readily devise their own implementations of the screw holding and driving device that incorporate one or more of the features of the present invention and fall within the spirit and scope of the present invention as defined herein.

What is claimed is:

1. A device for holding and driving a fastener into a work piece using a rotary drive apparatus and a tool bit configured for driving engagement with the fastener, the device comprising:

a body defining an elongated bore therethrough, and further defining a forward stop surface at a front end and rearward stop surface at an opposite rear end of said elongated bore;

a drive shaft rotatably disposed within said bore, and configured at one end for engagement to the tool bit and at an opposite end for engagement to the rotary drive apparatus;

a guide tube having a portion slidably disposed within said bore and defining;

a guide bore configured to slidably receive at least a portion of said drive shaft therethrough;

a seating surface on said portion of said guide tube configured to abut at least one of said forward and said rearward stop surfaces of said elongated body; and a spring contact surface; and a spring element disposed within said bore and arranged between said spring contact surface of said guide tube and the other of said forward and rearward stop surfaces of said elongated body, wherein said guide tube defines an annular bore along a portion thereof, said annular bore defining said spring contact surface and sized to receive a portion of said spring element therein.

2. The device for holding and driving a fastener according to claim 1, wherein said annular bore is concentric with and radially outward from said guide bore.

3. A device for holding and driving a fastener into a work piece using a driven rotary shaft carrying a tool bit configured for driving engagement with the fastener, the device comprising:

a body defining an elongated bore therethrough, and further having a front end and an opposite rear end, said body including a bearing element for rotatably supporting said body on the drive shaft with the tool bit projecting beyond said front end;

a guide tube having a portion slidably extending into said bore from said front end of said body and defining;

a guide bore configured to slidably receive at least a portion of said drive shaft therethrough, and a spring contact surface; and a spring element disposed within said bore and arranged between said spring contact surface of said guide tube and a portion of said body within said elongated bore, wherein said elongated bore of said body is open at said rear end; and wherein said body further includes a cap mounted thereon to close said bore at said rear end, said cap including an aperture for rotatably supporting said body on the drive shaft, and said cap defining a rearward stop surface for contacting said spring element within said bore.

4. A device for holding and driving a fastener into a work piece using a driven rotary shaft carrying a tool bit configured for driving engagement with the fastener, the device comprising:

a body defining an elongated bore therethrough, and further having a front end and an opposite rear end, said body including a bearing element for rotatably supporting said body on the drive shaft with the tool bit projecting beyond said front end;

a guide tube having a portion slidably extending into said bore from said front end of said body and defining;

a guide bore configured to slidably receive at least a portion of said drive shaft therethrough, and a spring contact surface; and a spring element disposed within said bore and arranged between said spring contact surface of said guide tube and a portion of said body within said elongated bore, wherein said spring element extends into said guide tube along a portion of the length of the guide tube.

5. The device for holding and driving a fastener according to claim 4, wherein said guide tube defines an annular bore along said portion thereof, said annular bore defining said spring contact surface and sized to receive a portion of said spring element therein.

6. The device for holding and driving a fastener according to claim 5, wherein said annular bore is concentric with and radially outward from said guide bore.

7. A screw holding and driving device, comprising:

a body defining an elongated bore therethrough;

a drive shaft assembly rotatably supported within said body, wherein said drive shaft assembly has (i) a shank portion at a first end portion thereof that is configured to be received in a chuck of a drill, and (ii) a bit retaining bore at a second end portion thereof, said bit retaining bore is configured to receive a screw bit therein, and wherein said drive shaft assembly further has a magnet located within said bit retaining bore;

a guide tube having a sidewall defining a guide bore, wherein said guide tube has a side opening defined in said sidewall that is configured to allow a screw to be advanced into said guide bore, and wherein said guide tube extends at least partially within said elongated bore of said body and is movable between an extended position and a retracted position; and a spring that biases said guide tube toward said extended position.

8. The device of claim 7, wherein:

said guide tube has a proximal opening and a distal opening, said proximal opening is located within said elongated bore of said body when (i) said guide tube is positioned in said extended position, and (ii) said guide tube is positioned in said retracted position, said drive shaft assembly defines an access opening for accessing said bit retaining bore of said drive shaft, and said access opening is interposed between said proximal opening of said guide tube and said side opening of said guide tube.

9. The device of claim 7, wherein said side opening of said guide tube is spaced apart from said distal opening of said guide tube.

10. The device of claim 7, wherein at least a portion of said guide tube is translucent, whereby a screw located within said guide tube may be visualized through said sidewall of said guide tube.

11. The device of claim 7, further comprising a depth adjustment sleeve, wherein:

said body includes an externally threaded portion, said depth adjustment sleeve includes an internally threaded portion that mates with said externally threaded portion of said body, and said depth adjustment sleeve is positioned around both said guide tube and said body during movement of said guide tube from said extended position to said retracted position.

12. The device of claim 7, wherein:

said spring is located in said elongated bore, and said spring is positioned around drive shaft assembly.

13. The device of claim 7, wherein:

said side opening includes (i) a shank opening portion having a first width, and (ii) a head opening portion having a second width, and said first width is smaller than said second width, whereby insertion orientation of a screw is predetermined.

14. The device of claim 13, further comprising said screw bit positioned within said bit retaining bore, wherein:

said screw bit includes a first bit end portion juxtaposed to said magnet and a second bit end portion configured to mate with a head of a screw, and said head opening portion is positioned adjacent to said second bit end portion of said screw bit when said guide tube is located in said extended position.

15. A screw holding and driving device, comprising:

a body defining an elongated bore therethrough;

a drive shaft assembly rotatably supported within said body, wherein said drive shaft assembly has a shank portion and a bit retaining bore, and wherein said drive shaft assembly further has a magnet located within said bit retaining bore;

a screw bit located within said bit retaining bore;

a guide tube having a guide bore, wherein said guide tube has a side opening defined in said guide tube, and wherein said guide tube extends at least partially within said elongated bore of said body and is movable between an extended position and a retracted position; and a spring that biases said guide tube toward said extended position.

16. The device of claim 15, wherein:

said guide tube has a proximal opening and a distal opening, said proximal opening is located within said elongated bore of said body when (i) said guide tube is positioned in said extended position, and (ii) said guide tube is positioned in said retracted position, said drive shaft assembly defines an access opening for accessing said bit retaining bore of said drive shaft, and said access opening is interposed between said proximal opening of said guide tube and said side opening of said guide tube.

17. The device of claim 15, wherein said side opening of said guide tube is spaced apart from said distal opening of said guide tube.

18. The device of claim 15, wherein at least a portion of said guide tube is translucent, whereby a screw located within said guide tube may be visualized through said guide tube.

19. The device of claim 15, further comprising a depth adjustment sleeve, wherein:

said body includes an externally threaded portion, said depth adjustment sleeve includes an internally threaded portion that mates with said externally threaded portion of said body, and said depth adjustment sleeve is positioned around both said guide tube and said body during movement of said guide tube from said extended position to said retracted position.

20. The device of claim 15, wherein:

said spring is located in said elongated bore, and said spring is positioned around drive shaft assembly.

21. The device of claim 15, wherein:

said side opening includes (i) a shank opening portion having a first width, and (ii) a head opening portion having a second width, and said first width is smaller than said second width, whereby insertion orientation of a screw is predetermined.

22. The device of claim 15, wherein:

said screw bit includes a first bit end portion juxtaposed to said magnet and a second bit end portion configured to mate with a head of a screw, and said head opening portion is positioned adjacent to said second bit end portion of said screw bit when said guide tube is located in said extended position.

* * * * *